US006449771B2

(12) United States Patent
Thompson

(10) Patent No.: US 6,449,771 B2
(45) Date of Patent: Sep. 17, 2002

(54) METHOD AND APPARATUS FOR FACILITATING THE APPLICATION AND REMOVAL OF GLOVES, SUCH AS DIVE GLOVES

(76) Inventor: Michael R. Thompson, 16460 Hwy. 3, #906, Webster, TX (US) 77598

( * ) Notice: Subject to any disclaimer, the term of this patent is extended or adjusted under 35 U.S.C. 154(b) by 0 days.

(21) Appl. No.: 09/817,720

(22) Filed: Mar. 26, 2001

Related U.S. Application Data

(60) Provisional application No. 60/192,483, filed on Mar. 27, 2000.

(51) Int. Cl.[7] ..... A41D 19/00

(52) U.S. Cl. ..... 2/159; 2/167; 2/161.5; 2/161.7; 442/327; 442/401

(58) Field of Search ..... 442/327, 401; 2/159, 167, 161.5, 161.7

(56) References Cited

U.S. PATENT DOCUMENTS 5,744,548 A * 4/1998 Nohr et al. ..... 525/106
5,829,057 A * 11/1998 Gunn ..... 2/69

* cited by examiner

*Primary Examiner*—Rodney M. Lindsey
*Assistant Examiner*—James G Smith
(74) *Attorney, Agent, or Firm*—Harrison & Egbert

(57) ABSTRACT

The device for facilitating the application and removal of dive gloves including a hand-conforming member formed of a spun-bonded high-density polyethylene or olefin fiber material. The hand-conforming member has a slick exterior surface. The hand-conforming member has an interior area suitable for receiving a human hand entirely therein. The member includes a top layer that is sewed around its periphery to a bottom layer. A wrist portion is connected to a hand-conforming member and is formed of the same material as the hand-conforming member.

16 Claims, 4 Drawing Sheets

METHOD AND APPARATUS FOR FACILITATING THE APPLICATION AND REMOVAL OF GLOVES, SUCH AS DIVE GLOVES

CROSS REFERENCE TO RELATED APPLICATIONS

The present application claims priority from U.S. Provisional Application Ser. No. 60/192,483, filed on Mar. 27, 2000, and entitled, "Method and Apparatus for Facilitating the Application and Removal of Gloves, such as Dive Gloves", presently pending.

BACKGROUND OF THE INVENTION

1. Field of the Invention

The present invention relates to gloves, in general. More particularly, the present invention relates to dive gloves and latex gloves. More particularly, the present invention relates to methods and apparatus for facilitating the application and removal of dive gloves and latex gloves from a human hand.

2. Description of Related Art

Cellular rubber, especially NEOPRENE™, has long been used as a body protection material. It is commonly used for wet suits because its insulating ability inhibits heat loss from a human body to surrounding cooler water. Wet suits are not intended to be waterproof, but rather allow a thin layer of water to exist between the cellular rubber and the body surface. The thin layer of water is warmed by the human body so that body heat is not lost to surrounding cooler water. While these conventional cellular rubber body protection materials function effectively as thermal insulation, they are notoriously uncomfortable if worn for any length of time. Wet suits and such cellular rubber material are very difficult to put on and remove because of the high friction and adhesive qualities of the cellular rubber against the skin that resist fitting the garment into place. This same characteristic resists any movement between the cellular rubber and adjacent skin and results in discomfort during bodily movement. The presence of a thin layer of water between the cellular rubber and the skin does little to reduce the adhesion between the cellular rubber and adjacent skin. Furthermore, perspiration is trapped between the cellular rubber and the skin, which causes a sticky, clammy and itchy sensation that adds to the feeling of discomfort. Cellular rubber is also known to irritate the skin of many wearers and causes allergic reactions in some cases.

Dive gloves are a type of glove worn by divers to protect their hands from sharp objects and various stinging sea life, and to keep hands and fingers warm. Dive gloves are available in several forms. Gloves are formed with a "short" wrist. Other gloves are formed with a "long" wrist (called "gauntlets"). There are also five finger, three finger or mitten type dive gloves. All of the dive gloves are formed of such tight-fitting cellular rubber material. These dive gloves are difficult to put on and take off, especially when wet.

Conventionally, in order to remove such tight-fitting wet cellular rubber gloves, normally one would have to "roll" the gloves down to take them off. However, dive gloves cannot be "rolled" down due to their thickness and tightness. Typically, the seams of the dive gloves will split and start weakening because of the strong pulling or stretching action required to remove the dive gloves or to put the dive gloves onto the person's hand. The problem of the application of dive gloves is a particular problem when one has suffered an injury to one's hands. If a great effort is required and such an effort cannot be accomplished, then the dive gloves simply cannot be placed on to the hands.

Hospital gloves are made of a latex material. This can cause an allergic reaction to the wearers of such gloves. Also, a great deal of talcum powder is used during the application of such gloves.

It is an object of the present invention to provide a device for facilitating the ability to apply and to remove dive gloves.

It is a further object of the present invention to provide a device which keeps the fingers of the wearer warm for longer periods of time.

It is a further object of the present invention to provide a device which enhances the life expectancy of the dive glove.

It is a further object of the present invention to provide a device which facilitates the ability to apply such dive gloves by persons having injuries or handicaps.

It is still another object of the present invention to provide a device which minimizes allergic reactions to cellular rubber and to latex.

It is still a further object of the present invention to provide a dive glove which minimizes the use of talcum powder on such gloves.

These and other objects and advantages of the present invention will become apparent from a reading of the attached specification and drawings.

SUMMARY OF THE INVENTION

The present invention is a device and method for facilitating the application and removal of gloves. The device of the present invention comprises a hand-conforming member formed of spun bonded high-density polyethylene or olefin fiber material. The hand-conforming member has a slick surface on the exterior side of the hand-conforming member. The hand-conforming member can be formed of a top part corresponding to the knuckles of the hand and a bottom part corresponding to the palm of the hand. The edges of the top part and the bottom part can be sewn together. The end edge of the hand-conforming member will extend downwardly over the wrist of the wearer. The hand-conforming member should have a suitable size so as to extend entirely over a conventional human hand. Insulating material can be placed on the interior surface of the hand-conforming member, if required.

The method of the present invention comprises the steps of: (1) forming a hand-conforming member of a porous spun bonded high-density polyethylene or olefin fiber material; (2) placing the hand-conforming member onto a human hand such that a slick surface of the hand-conforming member is on the exterior surface of the hand-conforming member opposite the human hand; and (3) sliding a glove over the exterior surface of the hand-conforming member until an end of the glove extends beyond an end of the hand-conforming member.

The process of the present invention can further comprise the steps associated with the removal of the glove. In particular, a portion of the glove can be grasped and pulled from the human hand. The hand-conforming member can either slide off of the human hand with the glove or can remain on the human hand while the glove is removed. If the hand-conforming member is retained within the interior of the glove, then it can simply be grasped and pulled easily from the interior of such glove.

DETAILED DESCRIPTION OF THE INVENTION

Figure 1:
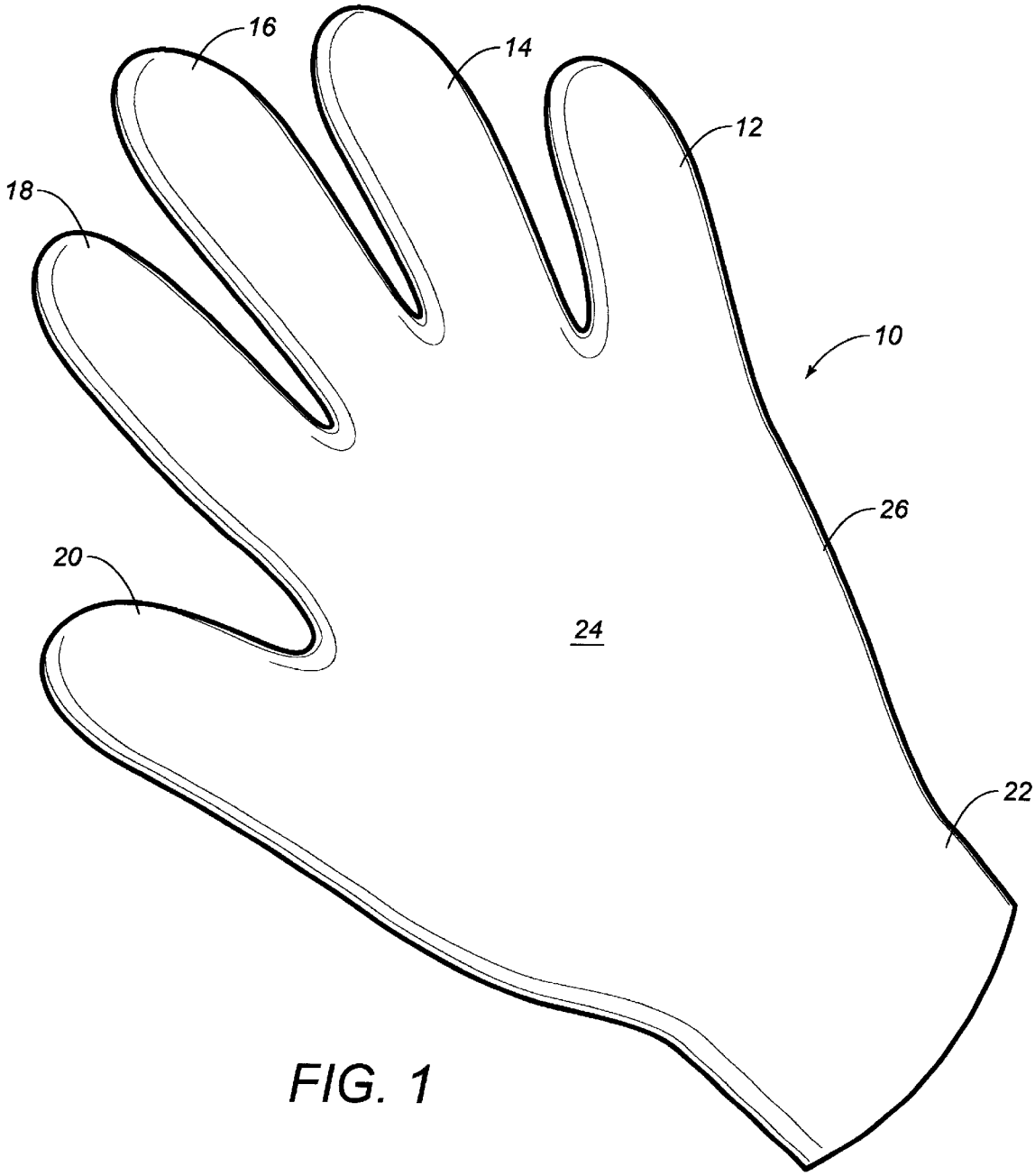
FIG. 1 is a plan view showing the preferred embodiment of the hand-conforming member in accordance with the teachings of the present invention.

Referring to FIG. 1, there is shown at 10 the hand-conforming member in accordance with the teachings of the present invention. The hand-conforming member includes fingers 12, 14, 16, 18 and 20. Finger 20 is intended to correspond to a human thumb. The hand-conforming member 10 also includes a wrist area 22 extending outwardly from central covering area 24. FIG. 1 shows the top 26 of the hand-conforming member 10. The bottom of such hand-conforming member 10 will have a configuration which matches the top part 26. The edges of the bottom part can be sewn around the periphery of the top part 26 so as to form the hand-conforming member 10.

Importantly, the hand-conforming member is formed of a spun bonded high-density polyethylene or olefin fiber material. This material is a non-woven multi-directional fibrous fabric, high-density polyethylene or olefin formed by a continuous process from very fine, 0.5–1.0 $\mu$m fibers. These non-directional fibers (plexifilaments) are first spun and then bonded together by heat and pressure, without binders or fillers. This material offers a balance of physical characteristics that combine some of the properties of paper, film and cloth. The material can contain an anti-oxidant which provides an oxidative life in excess of twenty years. This creates a new form of plastic material with properties different from those of low-density polyethylene. This high-density polyethylene or olefin is similar to normal woven fabrics having the properties of softness, loose flexibility and a porous structure. Importantly, the exterior surface of the hand-conforming member 10 will be a slick surface which provides lubrication so as to facilitate the application of the dive glove over the hand-conforming member 10.

Figure 2:
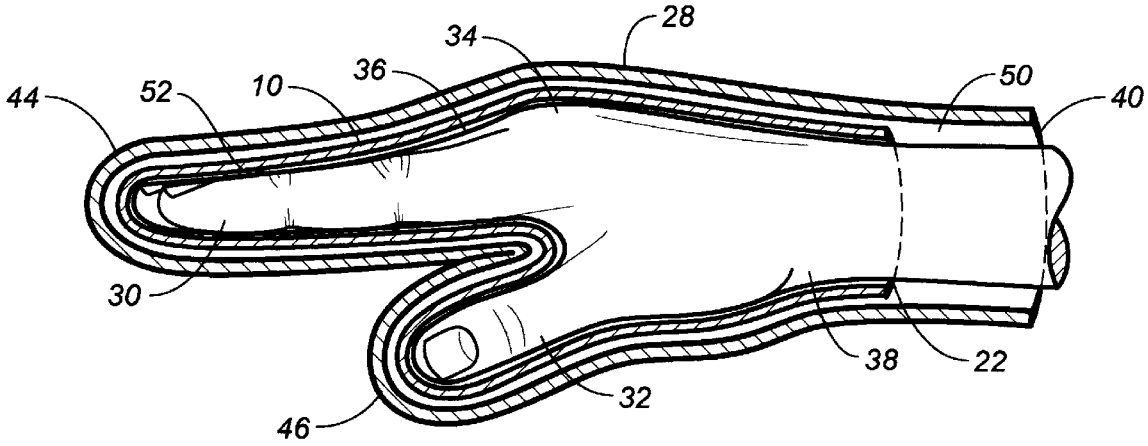
FIG. 2 is an interior, partially cross-sectional view of the hand-conforming member as applied to a human hand and within a dive glove.

FIG. 2 shows the application of a dive glove 28 over the hand-conforming member 10. Initially, it can be seen that the hand-conforming member 10 extends over the forefingers 30 and the thumb 32 of human hand 34. The hand conforming member 10 can be applied over the human hand 34 by simply sliding the interior 36 of the hand-conforming member 10 over the exterior surface of the human hand. The wrist area 22 of the hand-conforming member 10 will extend beyond the wrist area 38 of the human hand 34.

After the hand-conforming member 10 is applied over the human hand 34, the dive glove 28 can be properly installed over the human hand 34 by simply inserting the hand-conforming member 10 and the human hand 34 into the opening 40 at one end of the dive glove 28. The natural lubricating tendencies of the slick exterior surface of the hand-conforming member 10 will allow the dive glove 28 to slide easily over the hand-conforming member 10 and the human hand 34. As such, the fingers 44 of the dive glove 28 will reside over the fingers 30 of the human hand 34. Similarly, the thumb 46 of the dive glove 28 will reside over the thumb 32 of the human hand 34.

When it is desired to remove the dive glove 28 from the human hand 34, the end of the fingers 44 can simply be grasped and pulled outwardly away from the human hand 34. As such, the human hand 34 will exit the opening 40 at the end of the dive glove 28. The hand-conforming member 10 will either be retained within the interior 50 of the dive glove 28 or will be retained on the exterior surface of the human hand 34.

It is important to note that, in the concept of the present invention, the hand-conforming member 10 can have a suitable insulating or comfort material affixed to the interior surface 52 of the hand-conforming member 10. This insulating material can include a layer of aluminized polyester material, such as MYLAR™, positioned between the hand-conforming member and inner layer, such as cotton.

Figure 3:
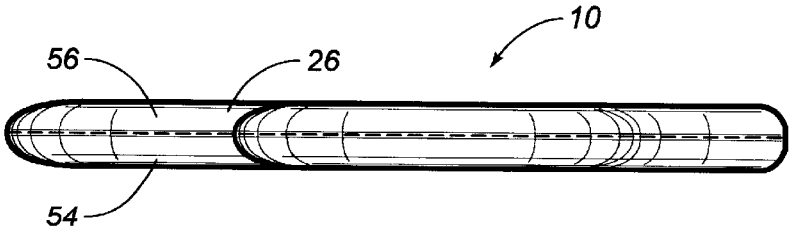
FIG. 3 is a side view of the hand-conforming member of the present invention.

FIG. 3 is a side view of the hand-conforming member 10. It can be seen that the hand-conforming member 10 has a top part 26 and a bottom part 54. The top part 26 is sewn to the bottom part 54 along edge 56.

Figure 4:
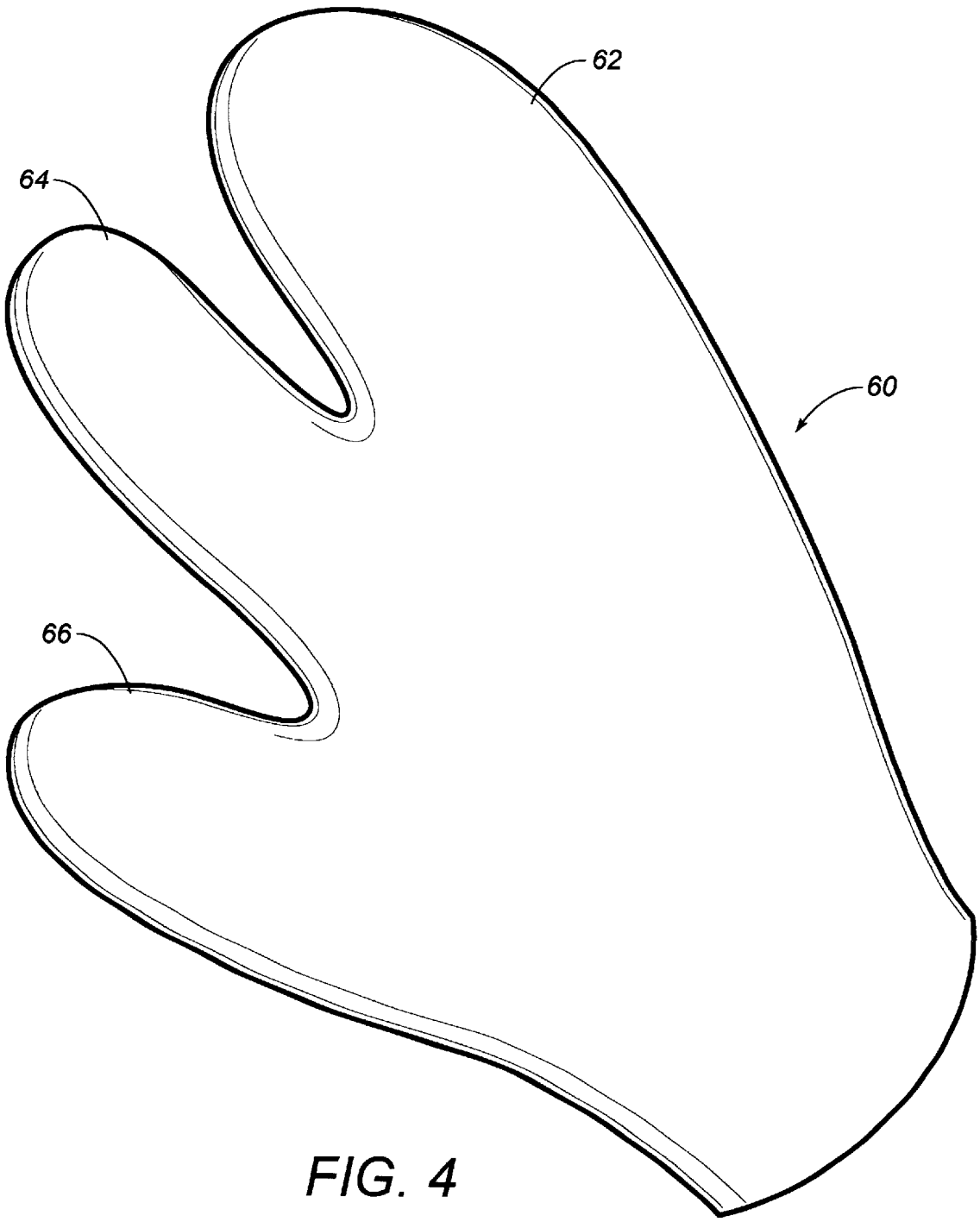
FIG. 4 is a plan view of an alternative emobidment of the hand-conforming member in accordance with the teachings of the present invention.

FIG. 4 shows an alternative embodiment 60 of the hand-conforming member of the present invention. Hand-conforming member 60 is a three-fingered mitten or gauntlet having fingers 62, 64 and 66. Hand-conforming member 60 is formed of a similar material as the hand-conforming member 10 and is constructed in a similar fashion.

Figure 5:
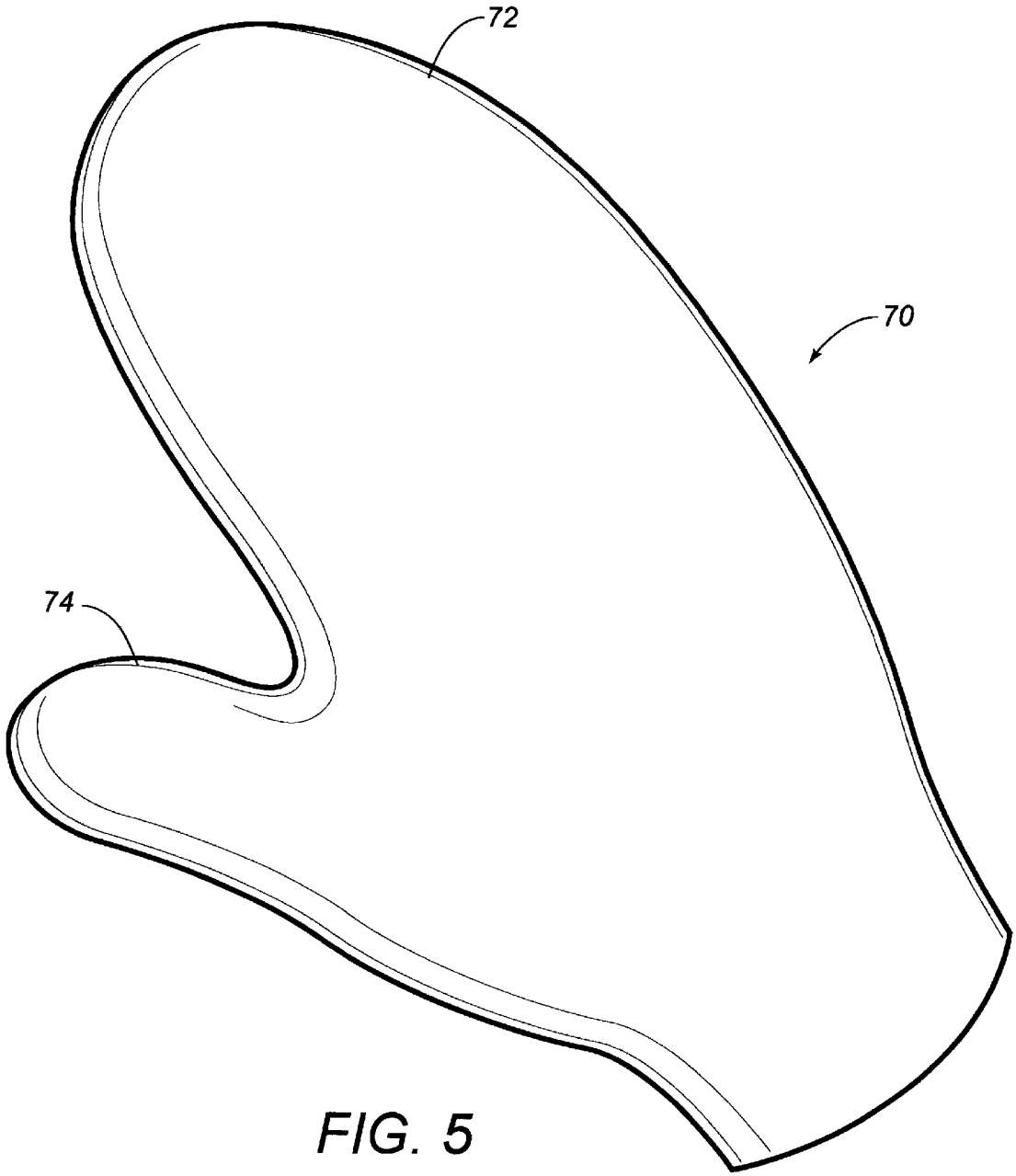
FIG. 5 is a plan view of a second alternative embodiment of the hand-conforming member in accordance with the teachings of the present invention.

FIG. 5 shows another alternative embodiment 70 of the hand-conforming member of the present invention. The hand-conforming member 70 is a mitten-type member having a finger encompassing portion 72 and a thumb portion 74. The hand-conforming member 70 is constructed in a similar manner as the hand-conforming member 10 of the preferred embodiment of the present invention.

The present invention is designed to be worn on the hands so as to enable the wearer to slide easily into dive gloves without excessive pulling or struggling. The present invention also enables the wearer to easily slide the dive gloves off, even if the dive gloves are wet. This can be accomplished without excessive pulling or struggling. The dive gloves can be removed from the hands without the need to "roll" the gloves down to take them off. The present invention also has a benefit in that it slows down the circulation of water within the dive glove so as to give the hand of the wearer more time to warm the water inside the dive glove. This keeps the wearer's hands and fingers warmer for longer periods of time in frigid waters. This also enables the wearer to work with hands and fingers for a much longer period of time since the fingers are not slowed down and will not become numb from the cold. The present invention is of great benefit when working with underwater instruments requiring precise or quick operations with the hands and fingers.

The present invention has the further benefit in that it extends the life of a dive glove. Because of the ability to easily remove the dive glove from the human hand, the wearer will not be pulling or stretching apart the seams of the dive glove to put it on or to take it off. Since there is no pulling or stretching, the glove will not tear and fingernails will not penetrate the dive glove. The present invention greatly assists the handicapped or any persons with an injury to their handgrip. The present invention takes very little effort to don or doff dive gloves, either wet or dry.

The present invention also facilitates the application and removal of any other form of tight-fitting glove. The present invention provides protection from allergic reactions caused from NEOPRENE™ rubber, latex or other materials of gloves. When used with latex gloves, the present invention will save hospitals from having to order and supply expensive specialized gloves for personnel who are allergic to the inexpensive later gloves. The present invention further dramatically cuts down on the absorption of talcum powder within latex gloves.

The foregoing disclosure and description of the invention is illustrative and explanatory thereof. Various changes in the details of the illustrated construction can be made within the scope of the appended claims without departing from the true spirit of the invention.

I claim:

1. A device for facilitating the application and removal of dive gloves comprising:

a hand-conforming member formed of a spun-bonded high-density fiber material, said member having a slick exterior surface, said member having an interior area suitable for receiving a human hand entirely therein, said member having an inner surface that is rougher than said slick exterior surface, said member comprising:

a top layer;

a bottom layer having a periphery thereof secured to a periphery of said top layer;

a first insulating layer fixed to an underside of said top layer; and a second insulating layer fixed to a top side of said bottom layer.

2. The device of claim 1, said periphery of said bottom layer being sewed to said periphery of said top layer.

3. The device of claim 1, said hand-conforming member being formed entirely of said spun-bonded high-density fiber material.

4. The device of claim 1, said fiber material selected from the group consisting of polyethylene fibers and olefin fibers.

5. The device of claim 1, said hand-conforming member having a plurality of fingers extending outwardly therefrom.

6. The device of claim 1, said hand-conforming member being in a form of a fingerless mitten.

7. The device of claim 1, further comprising:

a wrist portion connected to an end of said hand-conforming member, said wrist portion being formed of spun-bonded high-density fiber material, said wrist portion having an interior area suitable for allowing a human wrist to pass there through.

8. The device of claim 7, said wrist portion being integrally formed with said hand-conforming member.

9. A method of facilitating the application of a dive glove onto a human hand, the dive glove having a finger portion and a wrist portion opposite said finger portion, the method comprising:

forming a hand-conforming member of a porous spun-bonded high-density fiber material;

placing the hand-conforming member onto a human hand; and sliding the dive glove over an exterior surface of said hand-conforming member such that an end of said hand-conforming member resides beyond said wrist portion of the dive glove.

10. The method of claim 9, said exterior surface of said hand-conforming member being slicker than an interior surface of said hand-conforming member.

11. The method of claim 9, said dive glove being formed of a cellular rubber material.

12. The method of claim 9, said fiber material being a polyethylene fiber material.

13. The method of claim 9, said fiber material being an olefin fiber material.

14. The method of claim 9, said step of forming a hand-conforming member comprising:

forming a top layer of said fiber material;

forming a bottom layer of said fiber material; and sewing a periphery of said top layer to a periphery of said bottom layer so as to define a hand-receiving volume between said top layer and said bottom layer.

15. A method of facilitating the removal of a dive glove from a human hand comprising:

interposing a hand-conforming member between the dive glove and the human hand, the hand-conforming member being formed of a spun-bonded high-density fiber material, the dive glove being formed of a cellular rubber material;

grasping a portion of the dive glove;

pulling the dive glove from the human hand; and removing said hand-conforming member from an interior of the dive glove subsequent to said step of pulling the dive glove.

16. The method of claim 15, said hand-conforming member having a slick surface and a roughen surface, said step of interposing comprising:

positioning said slick surface against an interior surface of the dive glove.

* * * * *